US006636004B1

(12) United States Patent
Vollkommer et al.

(10) Patent No.: US 6,636,004 B1
(45) Date of Patent: Oct. 21, 2003

(54) DIMMABLE DISCHARGE LAMP FOR DIELECTRICALLY IMPEDED DISCHARGES

(75) Inventors: Frank Vollkommer, Buchendorf (DE); Lothar Hitzschke, Munich (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/806,038

(22) PCT Filed: Sep. 28, 1999

(86) PCT No.: PCT/DE99/03109

§ 371 (c)(1),
(2), (4) Date: Mar. 26, 2001

(87) PCT Pub. No.: WO00/21116

PCT Pub. Date: Apr. 13, 2000

(30) Foreign Application Priority Data

Oct. 1, 1998 (DE) ..... 198 45 228

(51) Int. Cl.[7] ..... H05B 41/16

(52) U.S. Cl. ..... 315/246; 315/260; 315/271; 313/620; 313/622; 313/632

(58) Field of Search ..... 315/56, 58, 246, 315/260, 271, 268, 291, DIG. 4; 313/620–622, 632, 608, 484, 491, 293, 298, 302, 303

(56) References Cited

U.S. PATENT DOCUMENTS 5,466,990 A * 11/1995 Winsor ..... 315/56
5,604,410 A * 2/1997 Vollkommer et al. ..... 315/246
5,760,541 A 6/1998 Stavely et al. ..... 313/491
5,965,988 A * 10/1999 Vollkommer et al. ..... 315/246
5,994,849 A * 11/1999 Vollkommer et al. ..... 315/246
6,016,027 A * 1/2000 DeTemple et al. ..... 313/356
6,060,828 A * 5/2000 Vollkommer et al. ..... 313/607

FOREIGN PATENT DOCUMENTS

| | | |
|---|---|---|
| DE | 43 11 197 | 10/1994 |
| DE | 198 17 479 | 6/1999 |
| FR | 2 761 525 | 10/1998 |
| WO | 94/23442 | 10/1994 |
| WO | 98/43276 | 10/1998 |
| WO | 98/44532 | 10/1998 |

OTHER PUBLICATIONS

Patent Abstracts of Japan, vol. 1996, No. 06, Jun. 28, 1996, & JP 08 031387 A, (Ushio Inc.), Feb. 2, 1996.

Patent Abstracts of Japan, Vol 1995, No. 06, Jul. 31, 1995, & JP 07 057704 A (Ushio Inc), Mar. 3, 1995, Zusammenfassung.

* cited by examiner

*Primary Examiner*—Haissa Philogene
(74) *Attorney, Agent, or Firm*—Carlo S. Bessone

(57) ABSTRACT

The discharge spacings in discharge lamps for dielectrically impeded discharges are shortened below 3 mm, as a result of which dead times of pulsed active-power injecting can be increased so strongly, for example beyond 50 ms, that the dimming properties of the discharge lamp are greatly improved.

19 Claims, 5 Drawing Sheets

DIMMABLE DISCHARGE LAMP FOR DIELECTRICALLY IMPEDED DISCHARGES

TECHNICAL FIELD

The present invention relates to a discharge lamp which is designed for dielectrically impeded discharges. For this purpose, the discharge lamp has a discharge vessel filled with a discharge medium, and an electrode arrangement with at least one anode and at least one cathode. Since the discharge lamp is designed for dielectrically impeded discharges, a dielectric layer is situated at least between the anode and the discharge medium. The anode and the cathode thereby define between them a discharge spacing in which dielectrically impeded discharges can be produced.

The terms anode and cathode are not to be understood in this case such that the discharge lamp would only be suitable for unipolar operation. It can also be designed for a bipolar power supply, in which case there is then no difference between the anode(s) and cathode(s), at least electrically. Consequently, in this application, what is said for one of the two electrode groups applies in the case of a bipolar power supply for both electrode groups.

The discharge lamps considered here have a large number promising fields of application. An important example is the backlighting of flat image systems, in particular LCDs (Liquid Crystal Displays).

A further point is the backlighting or lighting of signaling devices and signal lamps themselves. Reference is made regarding these two last points to the disclosure content, hereby referred to, of EP 0 926 705 A1. Reference is made, furthermore, to WO98/43277, also with regard to backlighting of flat display screens, and the disclosure content thereof is also referred to.

PRIOR ART

Since discharge lamps for dielectrically impeded discharges can be designed in the most varied sizes and geometries, and in the process achieve a relatively high efficiency on avoiding the typical disadvantages of classic discharge lamps with a mercury-containing filling, they are promising candidates for a large number of different technical fields of use.

Many technical attempts have been undertaken for the purpose in this case of maximizing parameters such as the light yield, the luminous flux, the luminance, the homogeneity of the luminance etc.

Particular reference is made regarding the prior art to patent abstracts of Japan 1996, No. 6, dated Jun. 28, 1996 and to the associated JP 08031387 A. This prior art describes a discharge lamp which is designed for dielectrically impeded discharges and in which a region with a small discharge spacing is provided in order to reduce the starting voltage. In one exemplary embodiment, this small discharge spacing is 2 mm. However, during operation discharges also burn in the whole discharge lamp in the region of larger discharge spacings.

SUMMARY OF THE INVENTION

The invention is based on the technical problem of improving a discharge lamp for dielectrically impeded discharges such that its possibilities of use are further expanded, and to specify a corresponding operating method for the discharge lamp.

Firstly, the invention proceeds from the finding that there is a range of applications for which it is important, in addition to, or instead of, the qualities required at the beginning, for it to be possible to operate the discharge lamp with a very low luminous flux. It was necessary for this purpose in the case of the invention to improve the properties of the lamp such that it permits the injecting of very low supply powers. This is possible according to the invention by virtue of the fact that the discharge spacing between the electrodes is selected to be particularly small. According to the invention, this discharge spacing between cathodes and anodes is 3 mm or less, preferably 2 mm, 1.5 mm, 1 mm, 0.8 mm or below and, with particular preference, 0.6 mm and below.

It is important in this case that electrode pairs with such a small discharge spacing need not occur exclusively in the discharge lamp. It is also perfectly possible to make use of larger discharge spacings in the same discharge lamp, because then it is possible, if appropriate, to operate the lamp, if required, only with the small discharge spacing according to the invention.

The substantial advantage of the short discharge spacings consists in that they permit particularly long dead times between the individual active-power pulses in the case of a pulsed power supply, without the production in this case of locally undesired high current densities.

Firstly, reference is made with regard to the operating method with the pulsed active-power injecting to WO 94/23442 and DE-P 43 11 197.1, whose disclosure content is hereby referred to.

In the case of this operating method, dead times during which no discharge burns in the discharge lamp occur between individual pulses in which the discharge lamp is supplied with active power. During the injecting pulses of active power, the discharge certainly need not burn continuously in this case; it is equally as little necessary for the discharge to be terminated directly after the end of the injecting of active power. In any case, specific dead times without discharges occur between the discharge ignitions during operation of the lamp.

If, now, the dead times between the discharges are greatly lengthened, this reduces the mean power thereby injected into the lamp, and therefore also the mean emitted optical power, at least as long as the amount of energy injected per pulse is not increased to compensate. Rather, it is preferred in the invention that the energy injected per active-power pulse remains substantially constant—including in the case of a power adjustment still to be treated below—that is to say is not consciously changed. Of course, in this case it can change somewhat owing to the changing electroparameters and discharge parameters because of the lengthening of the dead time, but this does not invalidate the invention.

At the present state of knowledge, it is to be regarded as a purely empirical result that particularly long dead times are possible in the case of the small discharge spacings according to the invention. It was, rather, expected that arcs destroying the dielectric form, because there is virtually no longer any physical coupling owing to the excessively long dead times between the individual active-power pulses. In the case of the dead times "of normal length", an individual discharge structure forms an ionization of the discharge medium which is removed after extinction of the discharge pulse. The next discharge pulse then ignites in a still somewhat preionized region of the discharge medium, thus also giving rise to the temporal and spatial homogeneity of the overall discharge picture which is the aim of the pulsed mode of operation.

If dead times now become too long, in the case of conventional discharge spacings this coupling no longer takes place between the individual discharge pulses, and so each discharge pulse is, as it were, comparable to a new ignition which initially exhibits an arc-shaped discharge. The arcs repeated with each pulse render completely impossible permanent operation of the lamp and efficient homogeneous production of light; the discharge lamp is, however, in general damaged and therefore destroyed earlier.

It was surprising, moreover, that also no substantial acoustic problems arose with the invention. In the case of "conventional" discharge spacings, bothersome piping noises were found at excessively low frequencies, that is to say frequencies in the audible range, these noises being produced by coupling of the pulse frequency of the discharges to the discharge vessel via various mechanisms of no interest here. However, it is to be seen in the case of the invention that such problems virtually do not occur any more, probably owing to the small discharge spacings with a thereby reduced coupling, on the one hand, and probably owing to the in any case greatly reduced powers, on the other hand.

The invention therefore relates to an operating method in which the dead time between the active-power pulses can be set in order to set the lamp power, and this corresponds to a dimming method in the case of adjustability during operation of the lamp.

Above all, however, the invention addresses an operating method in which, as set forth above, use is made of particularly long dead times, in particular longer than the values already mentioned. This also includes operation of the discharge lamp at only this one low power, or the one long dead time.

It is also provided according to the invention for one or more further discharge spacings to be provided in a discharge lamp in addition to the small discharge spacing according to the invention. In this case, in particular, it is provided, specifically in combination with an auxiliary ignition function described further below, or independently thereof, to be able to operate these electrode groups with different discharge spacings separately. It is then possible during operation to operate various power stages with different electrode groups or different combinations of electrode groups, and thus to select optimum operating parameters in each case.

The disclosure content of DE 198 17 479 A1 is referred to in relation to the splitting of the electrode arrangement into separately operable groups.

In particular, electrode groups with a larger discharge spacing can be used for higher powers of the discharge lamp, because better efficiency is generally to be achieved given the larger discharge spacings. In any case, the small discharge spacings according to the invention are not really advantageous with regard to the efficiency of the production of light. However, this is generally of subordinate interest, because the aim is particularly low powers for which the absolute losses occurring from the worsened efficiency are low in any case.

A substantial problem in the efficiency of gas discharge lamps is, in particular, the heat budget which, however, does not play a critical role at low powers in the case of the worsening of the efficiency mentioned here, because, as mentioned, the losses are low in absolute terms.

If, then, a substantially lower power is to be adjusted—whether after switching on the discharge lamp anew, or for the purpose of dimming during operation—an electrode group (or a plurality of electrode groups) with the small discharge spacing according to the invention is used for this purpose below a specific power. If only discharges over the low discharge spacing are operated, substantial reductions in lamp power are possible in this case.

In order to ensure as continuous as possible a transition or a smooth dimming response, the discharge lamp is preferably designed such that the power ranges possible with the aid of the various discharge spacings overlap one another. In this case, upon "switching over" from one discharge spacing to the other, jumps in efficiency, and thus discontinuous jumps in luminous flux given a continuous power characteristic, can certainly occur. By adapting the dimming response of a ballast with the aid of appropriate power jumps in order to compensate for jumps in efficiency when switching over between discharge spacings, it is, however, also possible to remove these small discontinuities if they are disturbing.

Finally, it is also possible during full-load operation of the discharge lamp to ignite discharges over all discharge spacings present, and thus to achieve a further power gain through the discharges over the small discharge spaces. This need not necessarily be linked to a loss in efficiency if, in accordance with the following explanation, an arrangement is selected in the case of which a certain auxiliary ignition function is present between different discharge paths. The so-called case losses can be reduced thereby.

With regard to the electrode arrangement of the discharge lamp, a particular configuration of the invention consists in that, in addition to an anode and a cathode (it being possible for further anodes and cathodes to be present), a further electrode is provided which is assigned to the anode and the cathode for the purpose of dielectrically impeded discharge, specifically to the cathode at the small discharge spacing according to the invention, and to the anode at a larger discharge spacing. Consequently, the additional electrode can act as an anode with regard to the small discharge spacing, and as a cathode with regard to the larger discharge spacing. This has the particular advantage that the "damming", caused by the particular mode of operation of the dielectrically impeded discharge, of electrons before the anode from the discharge over the short discharge spacing prepares, as it were, the discharge over the longer discharge spacing by virtue of the fact that the dammed electrons from the electrode then acting as cathode facilitate the ignition of this further discharge.

It is particularly preferred in this respect that the discharges over the smaller and the larger discharge spacing are not only operated together, that is to say simultaneously in the sense of macroscopic times, but that, moreover, a fixed phase relationship exists between the active-power pulses for the two discharges, said relationship being suitably selected with regard to the described ignition support function of the discharge over the smaller spacing for the discharge over the larger spacing.

It is helpful in this regard to be clear that the discharge over the small discharge spacing is very easy to ignite, because of this shortness of the discharge spacing, specifically also in the case of low powers. To that extent, it makes sense to support the comparatively difficult to ignite discharge over the larger discharge spacing by there already being an accumulation of electrons in the region of the cathode, that is to say on the dielectric and directly above the dielectric. (The electrode considered here must be covered by a dielectric in this embodiment, because it acts as anode, inter alia.)

It is to be stated in particular that the discharges over the larger discharge spacing can also be operated with substantially lengthened dead times by means of the auxiliary ignition function described. In connection chiefly with the above-described fixed phase relationship, this means in practice that the small discharge spacing is still switched on in the range of "conventional" powers, the auxiliary ignition function permitting also discharges over the larger spacing to be dimmed down far below the conventionally achievable power range. In the case of very low powers, it is then possible in some circumstances to adjust a yet lower power by exclusive operation of the discharges with the small discharge spacing.

A further possibility which points in the same direction consists in replacing this "double-function electrode" by two electrodes. One of these electrodes is assigned as anode relative to the cathode provided at the small discharge spacing to the extent that the other of these electrodes is assigned as cathode in relation to the anode provided at the larger discharge spacing. When these two electrodes are sufficiently closely adjacent, an auxiliary ignition function in the already described sense is likewise possible.

In accordance with a further aspect, the already described measures according to the invention are supplemented by a configuration of the electrode arrangement in favor of dimmability already in the case of conventional discharge spacings. For this purpose, the electrode arrangement is configured inhomogeneously along a so-called control length such that there is a change in a burning voltage of the discharges within the control length. For the sake of clarity, reference may be made here to the preceding German patent application "Dimmbare Entladungslampe fur dielektrisch behinderte Entladungen" ["Dimmable discharge lamp for dielectrically impeded discharges"] dated Sep. 29, 1998, file reference 19844720.5. The disclosure content of this application is, once again, incorporated by-reference.

A sinusoidal course at least of some of the electrodes is particularly preferred in this connection, the inhomogeneity being represented as a change in the discharge spacing, and thus in the burning voltage.

As already mentioned, the method according to the invention for power adjustment, or the dimming method, uses the dead time between individual active-power pulses of a pulsed power supply as parameter for influencing the power. Within the framework of this invention, two concrete variants are preferred for configuring a corresponding electronic ballast. These two variants are summarized in claims 17 and 18. For further details, reference is made, in turn, to prior applications, specifically to the applications entitled "Elektronisches Vorschaltgerat für Entladungslampe mit dielektrisch behinderten Entladungen" ("Electronic ballast for a discharge lamp with dielectrically impeded discharges") 198 39 329.6 and 198 39 336.9, which come from the same applicant, as do all other cited applications. The disclosure content of these applications is also hereby referred to. The electronic ballasts described there using the forward converter principle, or using the flyback/forward converter principle, are clocked via a primary circuit switch—denoted there by $T_Q$—which is switched by a control device—SE there. To this extent, the dead time can be influenced by suitable selection of the electric parameters of the ballasts and of the discharge lamp by appropriate intervention in the control logic of this control device. Thus, the value of the dead time can be influenced by externally influencing a reference variable of this control device for time definition. Details on this are clear to the person skilled in the art.

In the combination of the described operating method according to the invention and the described discharge lamps according to the invention, the invention relates to a lighting system with such a discharge lamp and an electronic ballast which is designed correspondingly and is not necessarily as claimed in claims 17 and 18.

As already mentioned at the beginning, display screens, signal lamps, lighting and backlighting of signaling devices etc. come into consideration as preferred application. By way of generalization, this field of application can be summarized by information displays of any type at all. Specifically, when information is being displayed, the readability of the information from the display device under different ambient conditions plays a very substantial role. This relates chiefly to the freedom from glare in the case of rather dark ambient conditions, and to the readability in the case of brighter surroundings or unwanted light. An adjustable power range of the discharge lamps which is as wide as possible is highly important for adaptation.

This relates, chiefly, to the field of traffic technology, for example lamps in the interior of vehicles. Reference is made here by way of supplement to the disclosure content of EP 0 926 705 A1 (already cited). As already stated, monitors and display screens also come into consideration. There is a need there for adjustment ranges for the luminous flux, typically 1:100, which cannot be implemented even approximately with discharge lamps without the invention (typically 1:5 to date). The field of office automation, for example lamps in scanners, also comes into consideration.

DESCRIPTION OF THE DRAWINGS

Concrete exemplary embodiments of the invention are described below in more detail, being illustrated schematically in the figures. Individual features disclosed in the process can be essential to the invention in themselves in each case or in combinations other than those illustrated.

BEST MODE FOR CARRYING OUT THE INVENTION

Figure 1:
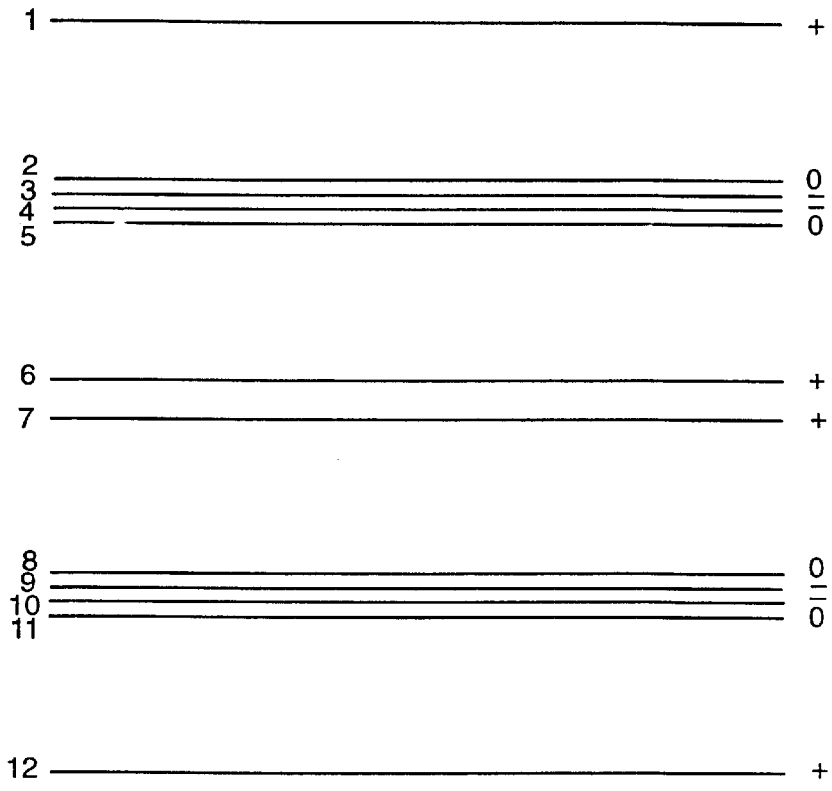
FIG. 1 shows a schematic of an electrode arrangement according to the invention.

Twelve enumerated electrode strips which are deposited on a wall (not illustrated) of a flat radiator discharge vessel are illustrated in the electrode arrangement, illustrated in FIG. 1, as first exemplary embodiment of the invention. Of course, they can also be deposited in a different way on various walls, for example the opposite insides of plates of a flat radiator discharge vessel.

In this case, the electrode strips 1 and 2, 5 and 6, 7 and 8 as well as 11 and 12 in each case have a spacing of 4 mm from one another which is a larger discharge spacing in the sense of the introduction to the description. By contrast therewith, the electrode strips 2, 3, 4, 5, on the one hand, and 8, 9, 10, 11, on the other hand, are situated one below another in spacings of 0.4 mm, that is to say small spacings according to the invention. The electrode strips 6 and 7 are spaced apart from one another by approximately 2–3 mm.

The following mode of operation is possible in accordance with the poling, illustrated on the right-hand side of FIG. 1, of the individual electrode strips: the outer electrode strips 1 and 12 and the middle electrode strips 6 and 7 are at positive potential, and are therefore connected up as anodes. The inner electrode strips 3, 4, 9, 10 in the groups of four, closely spaced in each case, are at negative potential, that is to say they are cathodes. The remaining electrode strips 2, 5, 8, 11 are at a potential between the previously named potentials, but substantially closer to the negative potential. This is specified by 0 in FIG. 1 for the sake of simplicity. In this case, the respective potentials can be switched optionally, that is to say the electrode strips 1–12 need not be supplied electrically at the same time.

According to the invention, it is now possible to operate discharges over the discharge spacings between electrode pairs 2 and 3, 4 and 5, 8 and 9 as well as 10 and 11, respectively, with very low powers and/or luminous fluxes in a dimming range of the flat radiator. Since these electrode spacings are extremely short at 0.4 mm, these discharges are very easy to ignite and, in accordance with this invention, can even be driven with dead times in the region of 1 ms and above. By shortening or lengthening the dead times, the flat radiator can also easily be further dimmed at very low powers.

It remains to add in this respect that a yet steeper reduction in the radiated luminous flux beyond the relative reduction undertaken in the supply power (by comparison with the full load of the flat radiator) results, as previously mentioned above, from the markedly worsened efficiency of the discharges over the large discharge spacings. In order to specify here an order of magnitude which is not to be understood as limiting, the efficiency of the discharges over the short discharge spacing of 0.4 mm is worse in this example by approximately a factor of 5 than for the higher-powered discharges over the larger discharge spacing of 4 mm.

It is possible, in turn, to ignite and operate discharges over this larger discharge spacing between electrode strips 1 and 2, 5 and 6, 7 and 8 as well as 11 and 12, said discharges corresponding per se to the prior art, and cause the flat radiator to emit a high luminous flux in conjunction with good efficiency.

Relative power changes during dimming of at least 10:1 are typically possible with this invention. Given appropriate design of the discharge spacings and adjustable dead times, it is also possible to achieve values of 20:1, 50:1 or even 100:1 and more. It is to be borne in mind that, owing to the already mentioned worsening of efficiency in the discharges over the short discharge spacings because of said relative power changes, it is possible to achieve actual relative changes in luminous flux which are amplified by the factor of the worsening of the efficiency. A typical value for this factor in the case of a discharge spacing of 0.4 mm is 5. Relative changes in luminous flux of 50:1, in the best case even of 500:1, can thereby be achieved with the invention.

In a transition region between the range of high powers and the range of very low powers, the illustrated electrode arrangement can be operated simultaneously with discharges over said long and said short discharge spacings. The term simultaneously relates in this case not to the individual active-power pulses, but only to macroscopic times in the sense of switching the discharge lamp on or off. The electrons dammed by the discharges over the short spacings on the intermediate potential electrode strips 2, 5, 8, 11 thereby come to the aid of the ignition of the discharges over the long discharge spacings. The dimmability of the discharges over the long discharge spacings can already be substantially extended to smaller powers by means of this interaction according to the invention between the discharges.

For even smaller powers, the flat radiator can then only still be operated with the discharges over the short discharge spacings.

In this exemplary embodiment, the electrode strips 3, 4, 9 and 10 are each to be understood as a doubly constructed cathode. This cathode separation can also be omitted, as illustrated by way of example by the second exemplary embodiment described below.

It is to be seen in FIG. 1, furthermore, that the electrode strips 6 and 7 are likewise to be interpreted as an anode formed as a pair. Reference is made to DE 197 11 892 A1 of the same applicant in relation to this twin anode technology.

The electrode arrangement illustrated in FIG. 1 is, of course, to be interpreted only as an excerpt from a possibly very much larger electrode arrangement. FIG. 1 illustrates that the electrode strips 1–6 and 7–12, respectively, in each case define an "elementary cell" in the vertical direction in FIG. 1, which can be repeated as frequently as desired.

Figure 2:
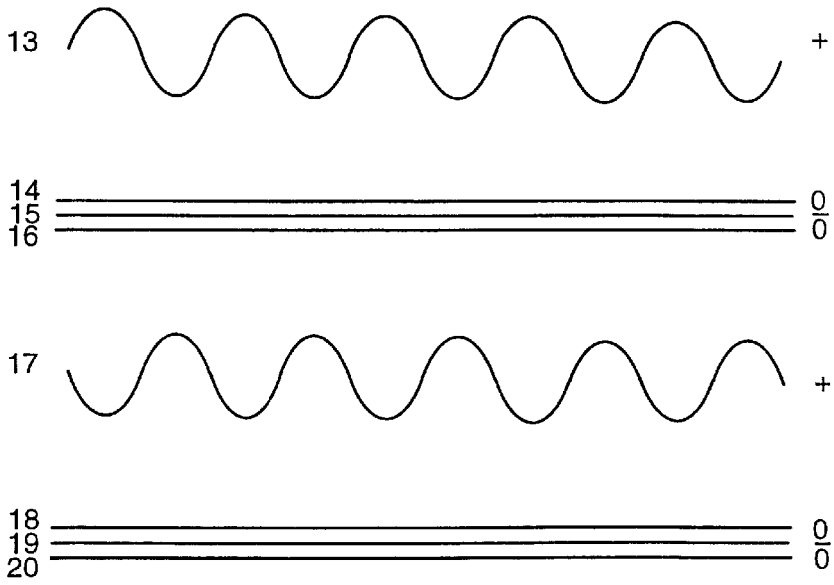
FIG. 2 shows a schematic of a further electrode arrangement according to the invention.

FIG. 2 also shows an illustration of an excerpt, specifically in addition to a second exemplary embodiment according to the invention. In this case, the twin anodes 6 and 7 from FIG. 1 are replaced by sinusoidally selected anodes 13 and 17. Reference is made for this purpose to the patent application entitled "Entladungslampe für dielektrisch behinderte Entladungen mit verbesserter Elektrodenkonfiguration" ["Discharge lamp for dielectrically impeded discharges with an improved electrode configuration"] from the same applicant dated Sep. 29, 1998, file reference 1984471.3. Reference is made in each case to the disclosure content of the cited applications.

Furthermore, the doubly constructed cathodes 3, 4, 9 and 10 from FIG. 1 are now single in each case, specifically as electrode strips 15 and 19.

In FIG. 2, the elementary cell corresponds, for example, to the electrode strips 15–19, and in this case juxtaposition would produce pairs of cathodes which are, however, combined in FIG. 2 to form individual electrode strips 15 and 19, respectively.

The discharge spacings correspond to the previous exemplary embodiment, the discharge spacing between electrodes 13 and 14, 16 and 17 as well as 17 and 18 fluctuating locally. Assuming that the structure illustrated in FIG. 2 is continued upward and downward, and therefore that a sinusoidal electrode has adjacent electrodes in both directions in each case, the upper and the lower halves of a sinusoidal electrode 13 and 17 are to be assigned respectively to other neighbors. This means, for example, for the electrode 17 that the "hills" (in the sense of FIG. 2) define a discharge spacing relative to the electrode strip 16, and the "valleys" do so relative to the electrode strip 18. These discharge spacings fluctuate in each case between 3 and 4 mm.

The local variation in the discharge spacing not only offers an alternative to the twin anode configuration illustrated in FIG. 1, but is, moreover, suitable for a conventional dimming technique already referred to in the introduction to the description. Reference is made to the application named there.

Of course, the alternatives illustrated here can also be combined otherwise, for example pairs of cathodes could be provided in FIG. 2. It is also conceivable to design the closely adjacent electrode strips in their small discharge spacing according to the invention to meander sinusoidally or in another way.

Reference is made to the various applications cited with regard to the further technical details of the gas discharge lamps. A few data may be named by way of example: the electrode tracks were 0.6 mm wide. An energy of 80 $\mu$J was injected per pulse. It was possible by varying the dead times to vary between full powers in the region of 8 W (exclusively with the large discharge spacings) and 0.8 W (at 10 kHz) or 0.08 W (at 1 kHz). A dimming range of the luminous flux of 1:500 corresponds to this.

Figure 3:
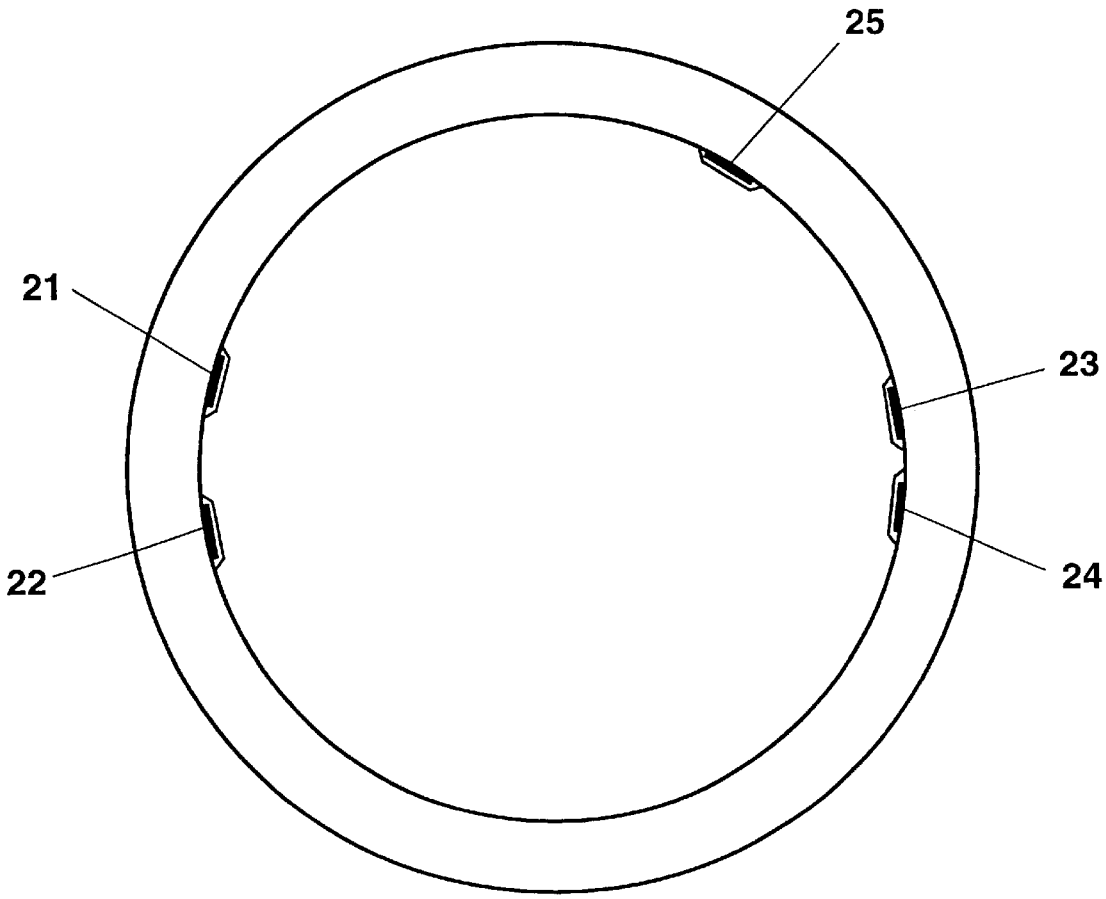
FIG. 3 shows a schematic of yet a further electrode arrangement according to the invention.

FIG. 3 shows a further exemplary embodiment, an electrode arrangement in a tubular discharge lamp being illustrated in a schematic cross-sectional illustration.

In the figure, numerals 21–25 refer to electrode strips which can be seen in cross section and are each covered with a dielectric layer. These electrode strips 21-25 are deposited on the inside of a glass cylinder discharge vessel with an inside diameter of 10.6 mm and an outside diameter of 12 mm. Various discharge spacings can be implemented with the arrangement illustrated, depending on which electrode strips are operated with which polarity. The following discharge spacings may be selected in this example:

| | |
|---|---|
| 23–24: | 0.5 mm |
| 21–22: | 1.5 mm |
| 23–25: | 4 mm |
| 21–25: | 8.3 mm |
| 22–23: | 10.5 mm |

It is thereby possible to implement small discharge spacings according to the invention with the discharge spacings between the electrode strips 23 and 24, on the one hand, and 21 and 22, on the other hand. In addition, three discharge spacings of different sizes between 4 and 10.5 mm are possible, as well. The efficiency of the discharges is improved still further in the region of larger discharge spaces, as well, and so the largest discharge spacing between the electrode strips 22 and 23 is optimal in this regard. On the other hand, relatively high voltages are required to ignite discharges over such discharge spacings, and it is necessary to inject comparatively high powers.

It is to be seen that it is possible to implement arrangements with multiple possible choices, in particular in the case of three-dimensional electrode geometries.

The auxiliary ignition function mentioned at the beginning can be illustrated here in two ways: on the one hand, with the electrode strip 24 as cathode, the electrode strip 23 as intermediate electrode and the electrode strip 25 as anode (in the sense of the symbols +, 0 and – from FIGS. 1 and 2). Furthermore with the electrode strip 22 as cathode, the electrode strip 21 as intermediate electrode and the electrode strip 25 as anode.

Such a dimmable tubular lamp is of interest, for example, as an edge lamp in the case of backlighting of flat display screens.

Figure 4:
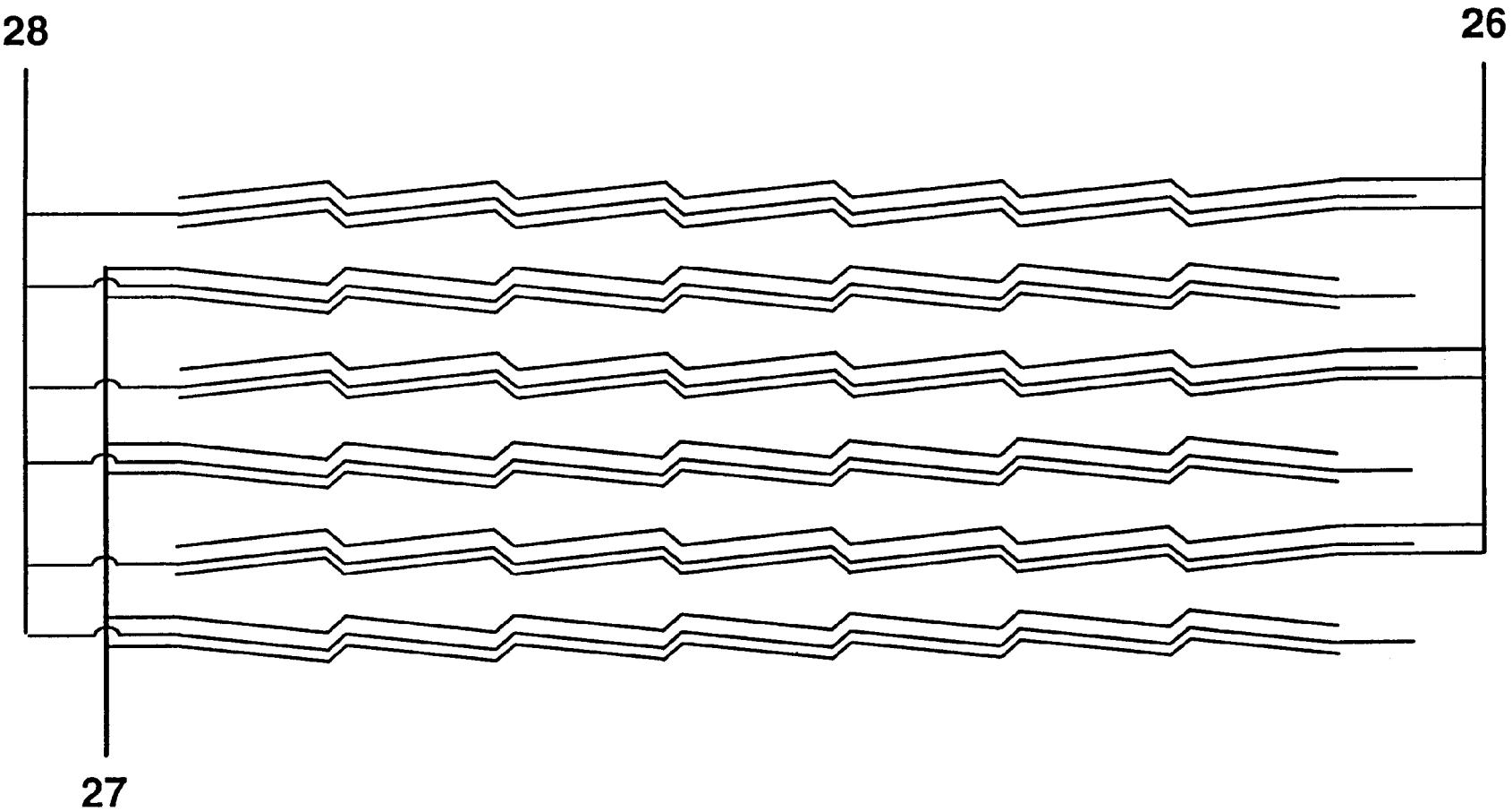
FIG. 4 shows a schematic of yet a further electrode arrangement according to the invention.

FIG. 4 shows a further exemplary embodiment of an electrode pattern for a flat radiator lamp. Here, three identical electrode tracks resembling sawteeth are respectively arranged in parallel in relatively close proximity. Next thereto, at a larger spacing, follows a mirror-image threefold arrangement parallel thereto, and so on. The two outer electrode tracks of each threefold arrangement or of each threefold arrangement which is the mirror image thereof are connected to common outer connecting tracks 26 and 27, respectively, to form electrode groups. Each middle electrode track, both of the threefold arrangements and of the threefold arrangements which are mirror images thereof, is connected to a further outer connecting track 28 to form a further electrode group. The individual "sawteeth" are asymmetric. They have a relatively long flat and a short steep ramp. Within each threefold arrangement, the spacing between the two outer electrode tracks and the inner electrode track therebetween is 3 mm and 2 mm, respectively. The smallest spacing between the tips of the sawteeth of the most closely adjacent threefold arrangements is 6 mm. The individual discharges (not illustrated) start there during operating when the connecting tracks 26 and 27 are connected as (instantaneous) cathode or anode (case I). The connecting track 28 is not connected in this case to any pole of an electric supply source (potential-free or floating potential). By contrast, the connecting tracks 26 and 27 are connected jointly as (instantaneous) cathode, and the connecting track 28 is connected as (instantaneous) anode in an operation provided for particularly low powers (case II). Consequently, the individual discharges burn exclusively between the respectively most closely adjacent electrode tracks of each threefold arrangement, the individual discharges respectively starting at the sawtooth tips and burning to the most closely adjacent middle electrode track. It is possible to switch over in a way known per se, for example electronically by means of relays or the like, between the two drive variants for the three electrode groups 26–28.

In unipolar pulsed operation, the following power ranges can be covered for a flat radiator lamp with the aid of the electrode pattern illustrated in FIG. 4 and the previously explained alternative drive variants.

| Driving of electrode groups | $U_s$[kV] | f[kHz] | P[W] |
|---|---|---|---|
| Case II | 1.56 | 8 | 0.6 |
| Case I | 1.69 | 80 | 3 |
| Case I | 1.73 | 80 | 5.4 |
| Case I | 1.81 | 80 | 9.6 |

Here, $U_s$ denotes the pulse peak voltage, f the pulse repetition frequency and P the mean electric power injected into the flat radiator lamp.

The electrode configuration can also be operated in bipolarly alternating pulsed operation in the case of two-sided dielectric impediment.

It is particularly to be noted that an arc-free discharge can still be obtained even in the case of a relatively low pulse repetition frequency (here 8 kHz, that is to say 10 times less than in case I), and consequently a correspondingly low mean electric power, by means of the short discharge spacing of approximately 2 mm (case II). In case I, the pulse peak voltage is the controlled variable for the electric power consumption. With increasing voltage, the delta-shaped partial discharge, initially starting at the peak (=smallest electrode spacing of approximately 6 mm) of each "sawtooth", widens along the longer ramp (=increasing electrode spacing) of the relevant sawtooth to form a structure widened like a curtain in which individual delta-shaped partial discharges are in any case no longer clearly detectable by sight.

In a variant (not illustrated) of the illustration in FIG. 4, a substantially straight electrode track can be provided between the threefold arrangements in each case. It is thereby possible to use a suitable third drive variant (case III) to implement a mean electrode spacing or discharge spacing.

Figure 5:
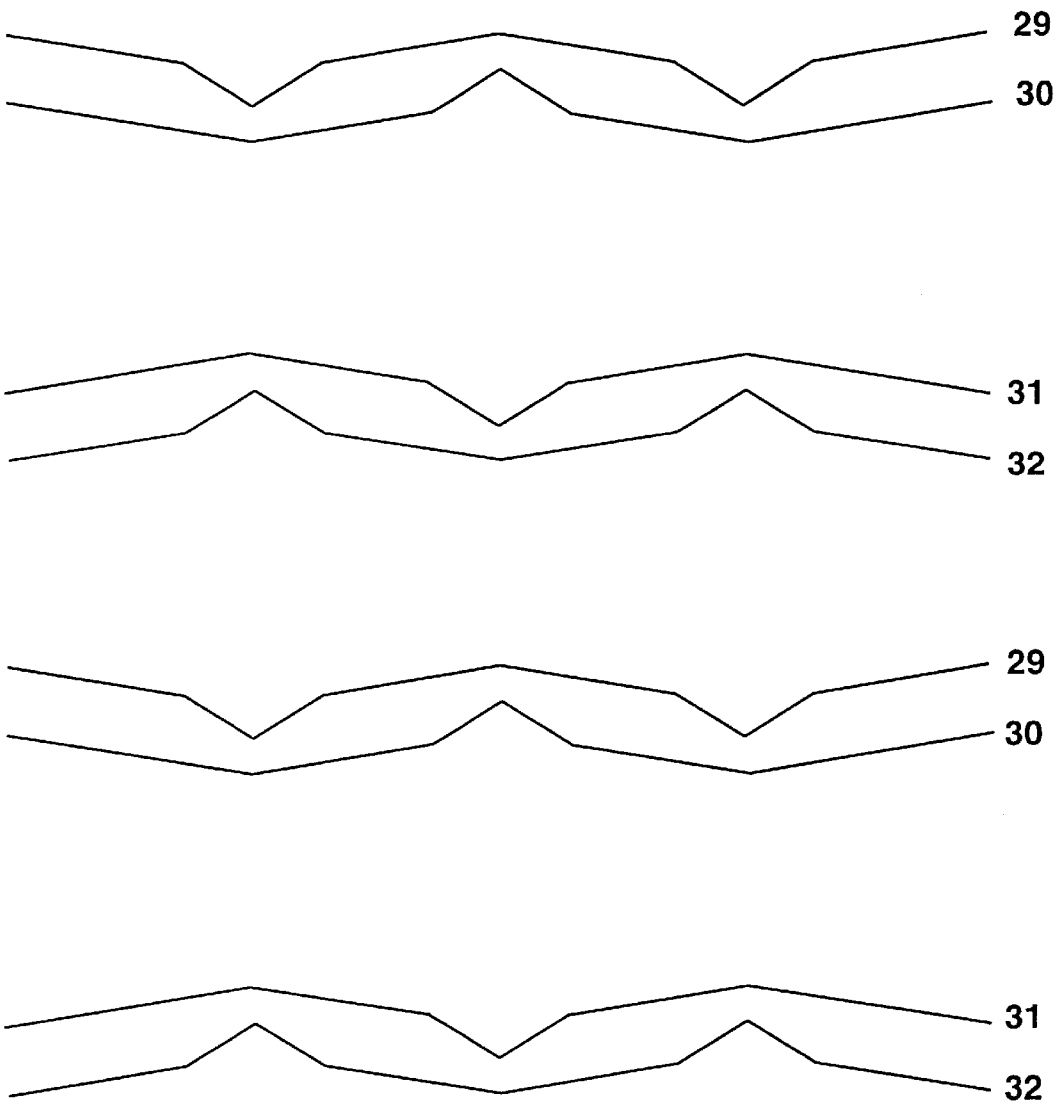
FIG. 5 shows a schematic of an excerpt from a further electrode arrangement according to the invention.

FIG. 5 shows a further exemplary embodiment of an electrode pattern according to the invention in a detail, that is to say without outer connecting tracks. The illustrated electrode pattern is, of course, to be understood only as an excerpt from a possibly very much larger electrode arrangement. By contrast with that from FIG. 4, this electrode pattern has the advantage that it manages with fewer electrode tracks and, in addition, has good homogeneity of the luminance distribution since—as yet to be explained further below—the individual discharges burn with a short or long arcing distance at virtually the same positions. Consequently, the spatial distribution of the discharge structure is largely maintained upon switching over to the respective alternative drive variant, in conjunction only with a different overall luminance.

Figure 6:
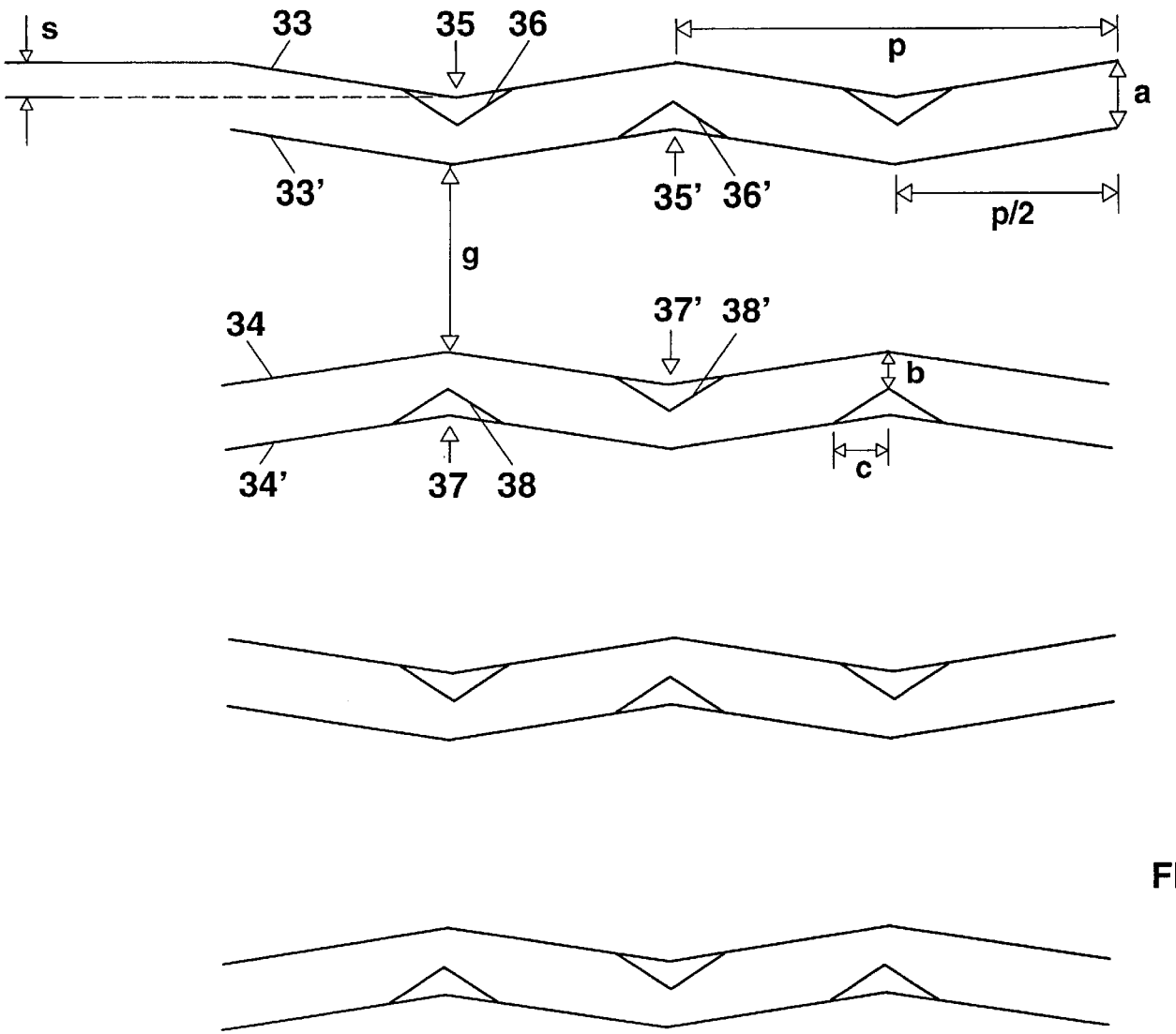
FIG. 6 shows a schematic for explaining the electrode arrangement from FIG. 5.

Two electrode tracks (29, 30) each having a complex shape are arranged relatively closely adjacent to one another in FIG. 5. They serve during operation to produce a discharge structure (not illustrated) with relatively small arcing distances. Following at a larger spacing from this twofold arrangement (29, 30) is a twofold arrangement (31, 32) etc. which is a mirror image thereof. During operation, the electrode tracks (30, 31; 32, 29) adjacent to one another at a larger spacing serve to produce a discharge structure (not illustrated) with relatively large arcing distances. Reference is made to FIG. 6 below for the purpose of explaining further details. The schematic serves in this case only to illustrate how the shapes of the electrode tracks (29–32) in FIG. 5 can be designed. For this purpose, two symmetric sawtooth electrode tracks (33, 33') are firstly conceived as being parallel to one another. The length p of the base of a "sawtooth" is 14 mm, the height s above the base is 1 mm. At the "kinks" 35, 35' of the sawtooth double line 33, 33', a subregion of the sawtooth tip facing the adjacent electrode track is respectively replaced by a wedge-shaped constriction 36, 36'. The half width c of each constriction 36, 36' is 2 mm. The shortest spacing b between the two electrode tracks in the region of the constrictions 36, 36' is 1.5 mm, in each case. Thereafter, the twofold arrangement 33, 33' with the constrictions 36, 36' is mirrored to produce the mirror-image twofold arrangement 34, 34' with the constrictions 38, 38'. This is repeated until the total electrode configuration is generated. The electrode configuration of FIG. 5 finally results by then further imagining the removal of the obsolete bridged parts at all the "kinks" 35, 35', 37, 37' in FIG. 6.

In one variant (not illustrated) of the illustration in FIG. 5, the constrictions can also be arc-shaped instead of wedge-shaped in design. As a result, the control properties of the discharge in the region of the constriction are "softer" in a fashion similar to the case of the arcs of the electrode tracks 13 and 17 in FIG. 2.

Moreover, it is also possible to dispense with the constrictions of one of the two electrode tracks of each twofold arrangement in accordance with FIG. 5, that is to say each second electrode track is only of sawtooth design. In the extreme case, each second electrode track can also be straight, or at least substantially straight. In any case, this reduces the number of constrictions inside each twofold arrangement, and consequently the number of partial discharges during operation. This variant is therefore suitable, in particular, for very low luminances in dimmed operation.

A concrete refinement of a flat lamp (not illustrated) may further be described below. The flat lamp has two parallel glass plates (thickness: 2 mm, dimensions: 105 mm times 137 mm) as main bounding walls. Mounted on a baseplate of the flat lamp is an electrode pattern, for example in accordance with FIG. 4 or, alternatively, in accordance with FIG. 5, or also a variant of a metal screen printed pattern. The actual electrode tracks are located in this case inside a frame (cross-sectional dimensions: height=breadth=5 mm) which connects the baseplate to a front plate and seals the discharge volume to the outside (inner surface of the baseplate: 78 mm times 110 mm). All the electrode tracks are covered with a glass solder layer of thickness 150 $\mu$m (discharge impeded on both sides) There follows a light-reflecting layer made from $Al_2O_3$ or $TiO_2$ on the baseplate and frame. All the inner surfaces have a three-band fluorescent layer. A spherical support point is fitted centrally between the baseplate and front plate. The electrode tracks are simply guided through under the seal of the glass solder frame in an extension with respect to their sections inside their discharge volume. The interior of the discharge vessel is filled with a xenon filling at a pressure of 13 kPa.

What is claimed is:

1. A discharge lamp having a discharge vessel, containing a discharge medium, an electrode arrangement with at least one anode (1, 6, 7, 12, 13, 17, 25, 29, 32) and at least one cathode (3, 4, 9, 10, 15, 19, 22, 24, 26, 30, 31), which define a small discharge spacing (b) of 3 mm or less, and having a dielectric layer between at least the anode (1, 6, 7, 12, 13, 17, 25, 29, 32) and the discharge medium, characterized in that at least two separately operable electrode groups (1, 2, 5–8, 11, 12; 2–5, 8–11; 13, 14, 16–18; 14–16, 18–20; 26, 27; 26, 27, 28) are provided in the case of at least one (2–5, 8–11, 14–16, 18–20, 26, 27, 28) of which the small discharge spacing (b) is present, and which differ from one another with reference to the discharge spacing (b).

2. The discharge lamp as claimed in claim 1, in which the electrode arrangement includes at least one electrode (2, 5, 8, 11) which is assigned on one side a cathode (3, 4, 9, 10) at the small discharge spacing (b), and is assigned on the other side an anode (1, 6, 7, 12) at a larger discharge spacing.

3. The discharge lamp as claimed in claim 1, in which the electrode arrangement (26, 27, 28) includes at least two closely adjacent electrodes, of which one is assigned a cathode at the small discharge spacing on one side, and the other is assigned an anode at a larger discharge spacing on the other side.

4. The discharge lamp as claimed in claim 1, in which the electrode arrangement (1–20, 26–32) is inhomogeneous along a control length in a form which varies a burning voltage over a relatively large discharge spacing.

5. The discharge lamp as claimed in claim 4, in which the at least one electrode (13; 17) has a substantially sinusoidal course.

6. The discharge lamp as claimed in claim 4, in which the at least one electrode (26; 27; 28; 29; 30; 31; 32) has a substantially sawtooth course.

7. The discharge lamp as claimed in claim 6, which has at least one arrangement of at least two electrodes (29, 30) with the small discharge spacing and at least one electrode arrangement (32, 31) which is the mirror image thereof, the smallest mutual spacing (g) of the most closely adjacent electrode arrangements being larger in each case than the smallest mutual spacings (b) of the most closely adjacent electrodes (29; 30) inside an arrangement (29, 30).

8. The discharge lamp as claimed in claim 7, in which the small discharge spacings (b) are implemented by constrictions (36, 36'; 38, 38') between the most closely adjacent electrode pairs of each electrode arrangement, each constriction (36; 36'; 38; 38') being formed between in each case two sawteeth of at least one electrode of each electrode pair.

9. The discharge lamp as claimed in claim 8, in which each constriction is formed in the shape of an arc or wedge.

10. A device for indicating information with the aid of a lamp as claimed in claim 1.

11. A method for operating a discharge lamp comprising the steps of: providing a discharge lamp having a discharge vessel, containing a discharge medium, an electrode arrangement with at least one anode (1, 6, 7, 12, 13, 17, 25, 29, 32) and at least one cathode (3, 4, 9, 10, 15, 19, 22, 24, 26, 30; 31), which define a small discharge spacing (b) of 3 mm or less, and having a dielectric layer between at least the anode (1, 6, 7, 12, 13, 17, 25, 29, 32) and the discharge medium, and varying power injected into the discharge lamp by varying a dead time between active-power pulses of a pulsed power supply.

12. The method for operating a discharge lamp as claimed in claim 11, in which the dead time between active-power pulses of the pulsed power supply is more than 50 $\mu$s.

13. The method as claimed in claim 11, in which energy injected into the discharge lamps per active-power pulse remains substantially constant.

14. The method as claimed in claim 11, in which the discharge lamp is provided with at least two separately operable electrode groups (1, 2, 5–8, 11, 12; 2–5, 8–11; 13, 14, 16–18; 14–16, 18–20; 26, 27; 26, 27, 28) in the case of at least one (2–5, 8–11, 14–16, 18–20, 26, 27, 28) of which the small discharge spacing (b) is present, and which differ from one another with reference to the discharge spacing (b).

15. The method as claimed in claim 14, in which the power is adjusted in a range of lower powers while only electrode pairs with the smaller discharge spacing are being operated, and the power is adjusted in a range of higher powers while also or only electrode pairs with the larger discharge spacing are being operated.

16. The method as claimed in claim 14, in which electrode pairs with the smaller discharge spacing are operated together with electrode electric pairs with a larger discharge spacing.

17. The method as claimed in claim 16, in which there is a fixed phase relationship between the active-power pulses for the electrode pairs with the smaller discharge spacing and the active-power pulses for the electrode pairs with the larger discharge spacing.

18. The method as claimed in claim 11, in which the discharge lamp is operated with a ballast which has a forward converter for injecting an external voltage pulse from a primary circuit via a transformer into a secondary circuit with the discharge lamp, in order to effect ignition in the discharge lamp and an internal counterpolarization, and has a switching device which interrupts the primary-side current flow through a transformer after ignition for the purpose of isolating the secondary circuit, in order to permit oscillation of the secondary circuit, in order to remove the charge effecting the external voltage at the discharge lamp, and to lead to a back ignition through the internal counterpolarization in the discharge lamp, the switching device varying the dead time running after the back ignition up to renewed ignition in the discharge lamp for varying the power injected into the discharge lamp.

19. The method as claimed in claim 11, in which the discharge lamp is operated with a ballast which has a combined flyback/forward converter, and has a switching device in a primary circuit which interrupts the current flow on the primary circuit side through a transformer for the purpose of injecting an external voltage pulse into a secondary circuit with the discharge lamp, in order to effect ignition and counterpolarization in the discharge lamp, and then for the purpose of switching on again the current flow through the transformer on the primary circuit side, in order, by means of a countervoltage pulse, to remove from the discharge lamp the charge effecting the external voltage at the discharge lamp, in order to effect a back ignition with the aid of the internal counterpolarization in the discharge lamp, the switching device varying the dead time running after the back ignition up to renewed ignition in the discharge lamp for the purpose of varying the power injected in the discharge lamp.

* * * * *